United States Patent [19]

Stoewe et al.

[11] 4,426,121

[45] Jan. 17, 1984

[54] PLUG FOR MASKING SWITCHING CONTACTS

[75] Inventors: Anneliese Stoewe; Gunter Hegner, both of Berlin, Fed. Rep. of Germany

[73] Assignee: Krone GmbH, Berlin, Fed. Rep. of Germany

[21] Appl. No.: 267,848

[22] Filed: May 28, 1981

[30] Foreign Application Priority Data

Jun. 18, 1980 [DE] Fed. Rep. of Germany ... 8016168[U]

[51] Int. Cl.[3] ..... H01R 13/44

[52] U.S. Cl. ..... 339/38; 339/198 R

[58] Field of Search ..... 339/38, 97 R, 198 R, 339/198 J; 179/1 PC

[56] References Cited

U.S. PATENT DOCUMENTS 3,808,585 4/1974 Izumida et al. ..... 339/198 J 4,221,445 9/1980 Fleischhacker et al. ..... 339/97 R

*Primary Examiner*—Eugene F. Desmond

*Assistant Examiner*—David L. Pirlot

*Attorney, Agent, or Firm*—Brown & Martin

[57] ABSTRACT

A plug for masking switching contacts, for instance in terminal strips of telecommunication devices, comprising an upper pulling head, a widened central supporting portion, and two lower spring tongues with a guiding web disposed therebetween. The plug is integrally formed and has the function of masking or, respectively, separating solderless, screwless and stripless switching contacts (so-called LSA-PLUS contacts) in terminal strips, wherein the contact points of these switching contacts are not touched by any parts of the plug so as to avoid contamination.

3 Claims, 6 Drawing Figures

PLUG FOR MASKING SWITCHING CONTACTS

The present invention relates to a plug for masking switching contacts, for instance in terminal strips of telecommunication devices.

A widely accepted connecting system—briefly called LSA-PLUS system—have been developed according to which the thin wires of telephone cables may be connected in a solderless, screwless and stripless operation to specially designed contact elements, for instance of terminal strips. These contact elements comprise at least two upright spring tongues defining a slot into which the respective wire is urged transversely to its axis. The spring tongues and the slot are of such dimensions that upon insertion of the wire the sharp side edges of the spring tongues will cut through the insulation while at the same time these side edges will slightly penetrate into the core material of the wire.

In this way an electrical connection will result which even after long operating times is electrically reliable and mechanically stable. Today's telecommunication devices and their terminal strips comprise a multiplicity of contact elements disposed closely adjacent each other in a confined space to enable the connection of a correspondingly large number of wires. Because of the standardized size of terminal strips it frequently happens that a certain number of switching elements are not required for a specific use.

It is the object of the present invention to provide a plug of the specified type by means of which the contact points of the contact elements may be separated from one another and/or may be masked without being touched, thus avoiding possible contamination caused by abrasion of plastic material.

In accordance with the invention this object is solved in that to an upper pulling head there is joined a widened central supporting portion at the bottom of which there are formed two spring tongues including locking projections, and a central guiding web disposed therebetween.

The spring tongues with their locking projections are of such configuration that upon insertion of the plug into the corresponding opening of the terminal strip they will separate the normally-closed contact of the contact element without touching the contact points at the spring lugs of said contact element, and will at the same time engage behind shoulders formed in the terminal strip. A reliable and non-displaceable location of the plug in the terminal strip is ensured by centering lugs integrally formed at the central supporting portion, which centering lugs upon insertion of the plug will engage in recesses provided for this purpose in the terminal strip.

To facilitate withdrawing or pulling-out of the plug the upper pulling head is formed with an opening adapted to accommodate a corresponding tool.

The plug is formed as an integral member of an insulating material, preferably as an injection-molded plastic part.

Embodiments of the present invention will be described below in detail with reference to the accompanying drawing, in which.

Figure 3:
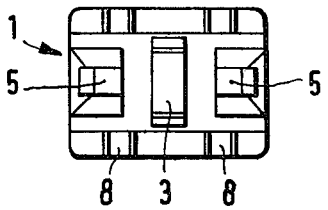
FIG. 3 is a plan view of the separator plug shown in FIG. 1.
Figure 1:
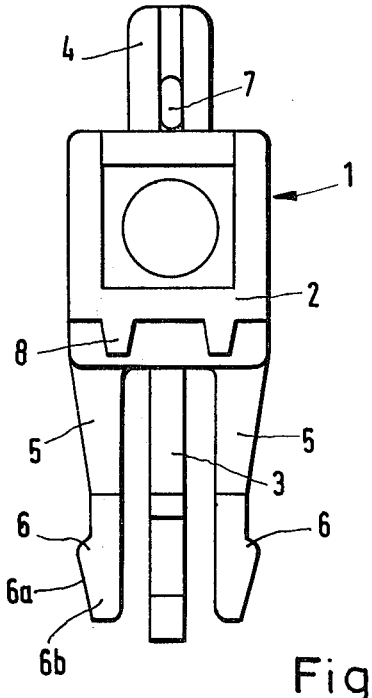
FIG. 1 is a front view of a separator plug.
Figure 2:
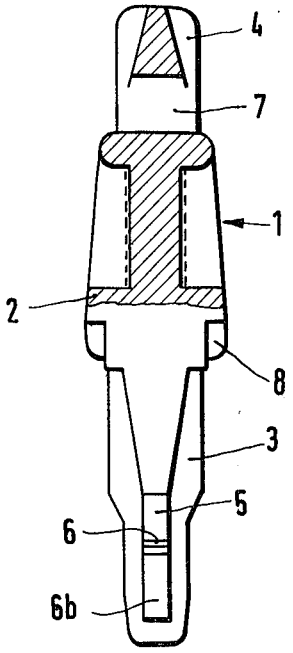
FIG. 2 is a partially sectioned side view of the separator plug shown in FIG. 1.

The separator plug 1 shown in FIGS. 1 to 3 is made of an integral synthetic plastic body and comprises a central widened supporting portion 2 the upper part of which is integrally joined with a pulling head 4 and the lower part of which is integrally formed with two spring tongues 5 having outwardly facing locking projections 6 and with a central guiding web 3 provided therebetween. Each of the locking projections 6 is formed with a lateral inclined ramp **6*a* and a lower extension 6*b*** having the function of separating normally-closed contacts in the terminal strip.

To secure the plug 1 inserted into the terminal strip against lateral displacement the bottom surface of the central portion 2 is integrally formed on either side with two respective centering lugs 8 having inclined faces. Also, a through-bore 7 is formed in the pulling head 4 and is adapted to accommodate a mating tool for withdrawing the plug.

When the plug is inserted into a corresponding opening in a terminal strip (not shown) the spring tongues 5 are bent laterally inwardly because of the inclined ramps **6*a* formed on the locking projections. When the plug 1 has reached its final masking position the two tongues 5 will spring back and the locking projections 6 will engage behind corresponding recesses formed in he terminal strip. At the same time, too, the centering lugs 8** will engage in corresponding notches or recesses formed in the terminal strip.

The contact points of the contact elements and, respectively, of the normally-closed contacts are thereby again separated by the extensions **6*b* of the locking projections 6, in which, however, abrasion of the plastic material of these parts of the separator plug 1** at the contact points of the contact elements is avoided such that the latter will stay clean.

Figure 6:
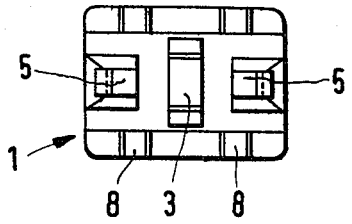
FIG. 6 is a plan view of the dummy plug shown in FIG. 5.
Figure 4:
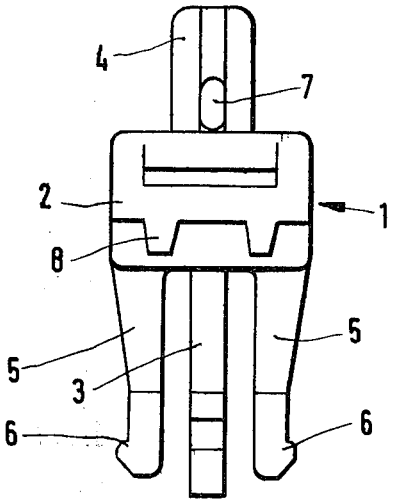
FIG. 4 is a front view of a dummy plug.
Figure 5:
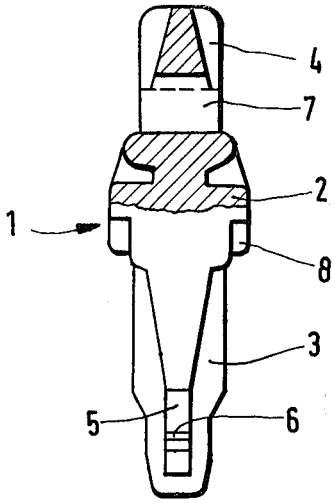
FIG. 5 is a side view, partially in section, of the dummy plug shown in FIG. 4.

In the embodiment shown in FIGS. 4 to 6, the essential parts of which correspond to those of the plug shown in FIGS. 1 to 3, the spring tongues 5 with their locking projections 6 as well as the central guiding web 3 are merely shortened thus resulting in a so-called dummy plug which closes the insertion opening in the terminal strip and prevents tapping. In this embodiment the normally-closed contact springs in the terminal strip will not be touched, because the extensions **6*b* of the spring tongues 5 of the separator plug shown in FIGS. 1 to 3 are omitted. The central webs 3 extend in parallel to the two spring tongues 5 with a predetermined spacing therebetween and include a narrower end portion having spherical guide faces which the end portion merges via inclined faces with a wider guide portion. This web 3 has the function of guiding the plug during insertion thereof into the opening provided in the terminal strip, which may be effected either by hand or with the aid of a tool engaging in the opening 7**.

We claim:

1. A plug for masking the insertion opening access to switching contacts in a terminal strip to prevent inadvertent connection to the contacts, said plug comprising:

a body portion;

an upper pulling head extending in one direction from said body portion;

spring tongue means extending in the opposite direction from said body portion;

locking projections on said spring tongue means;

extensions on said spring tongue means beneath said locking projections, said extensions being adapted for separating switching contacts in the terminal strip; and a central guiding web extending from said body portion in the same direction as said spring tongue means;

said body portion, pulling head, spring tongue means, locking projections and central guiding web all being integrally formed of a unitary piece of electrically insulative material;

said body portion being wider than said pulling head or said spring tongue means or said central guiding web so as to fully mask the insertion opening of the terminal strip;

said plug being adapted to be mounted to a terminal strip to make externally inaccessible the insertion openings therein and to cover a substantial portion of the lateral surface of the terminal strip in the vicinity of the contact access openings, and when said plug is so mounted to the terminal strip said spring tongue means and said central guiding web enter corresponding openings in the terminal strip, and said locking projections engage corresponding recesses in the terminal strip.

2. A plug according to claim 1, and further comprising a plurality of centering lug extensions integrally formed on said widened body portion and extending downwardly in the direction of said spring tongue means, said centering lugs being spaced on either side of said body portion and adapted to engage corresponding recesses in the terminal strip to prevent lateral displacement of said plug with respect to the terminal strip.

3. A plug according to claim 1 or claim 2, wherein an opening for a tool is formed in the pulling head.

* * * * *